United States Patent [19]

Bryan et al.

[11] 4,398,439

[45] Aug. 16, 1983

[54] POSITIONING GUIDE FOR RUBBER-LIKE MATERIAL ROTARY CUTTING MACHINE

[75] Inventors: Donald A. Bryan, Buchanan; William C. Maxey, Bedford, both of Va.

[73] Assignee: Rubatex Corporation, Bedford, Va.

[21] Appl. No.: 333,761

[22] Filed: Dec. 23, 1981

[51] Int. Cl.[3] ..... B26D 3/16; B65H 51/14

[52] U.S. Cl. ..... 83/356.3; 83/420; 83/422; 83/444; 198/626

[58] Field of Search ..... 83/356.3, 444, 449, 83/450, 420, 422; 198/626, 836

[56] References Cited

U.S. PATENT DOCUMENTS

| | | | |
|---|---|---|---|
| 3,104,579 | 9/1963 | Blankenship et al. | 83/444 X |
| 3,301,116 | 1/1967 | Owen | 83/444 X |
| 3,768,101 | 10/1973 | Kuts | 83/449 X |
| 3,915,291 | 10/1975 | Vogts | 198/626 |

*Primary Examiner*—Frank T. Yost

*Attorney, Agent, or Firm*—Mason, Fenwick & Lawrence

[57] ABSTRACT

A positioning guide for accurately positioning and guiding lengths of elongated rubber, plastic and other resiliant stock material having a predominately cylindrical exterior surface configuration being fed along a feed path to a cutting machine having a rotary knive and a pair of endless drive belts flanking the feed path. The positioning guide is formed of an integral elongated plate-like body of a length greater than the span of the drive belts along the feed path having a straight guide bore extending therethrough of circular cross-section at its opposite end. The plate-like body has a width and thickness greater than the diameter of the guide bore at the ends and having a pair of opposite elongated flat-bottomed depressions each forming a relief cavity in top and bottom faces of a plate-like body for receiving the confronting reaches of the drive belts so that the stock material is exposed in the region of the depressions for driving and positioning contact with the confronting drive belt portions.

12 Claims, 7 Drawing Figures

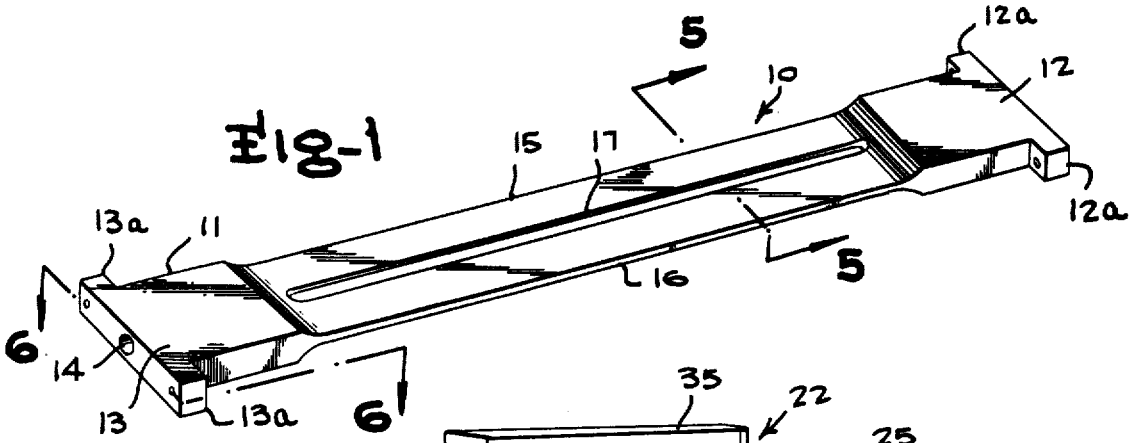
Fig-1
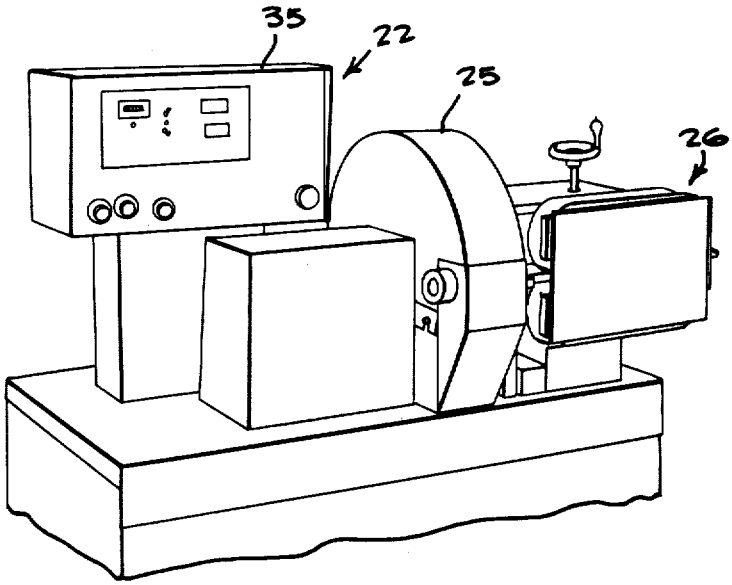
Fig-2
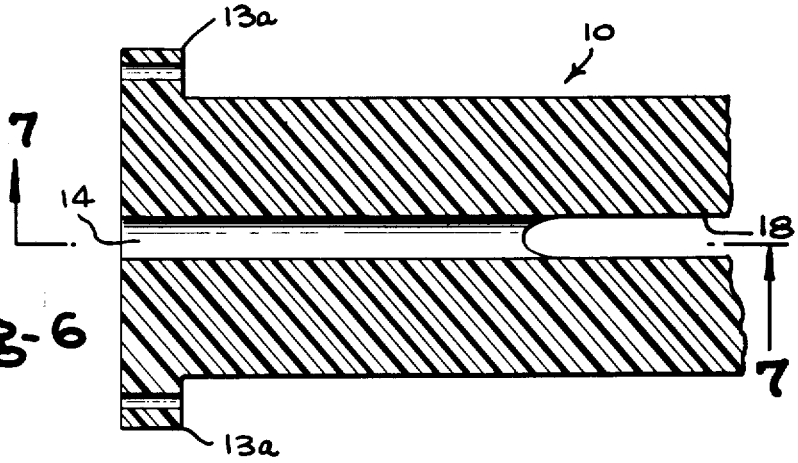
Fig-6
Fig-5
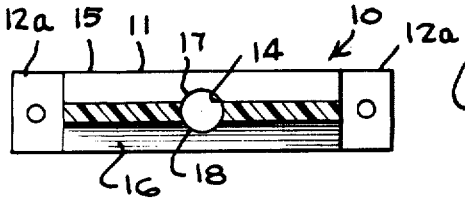
Fig-7
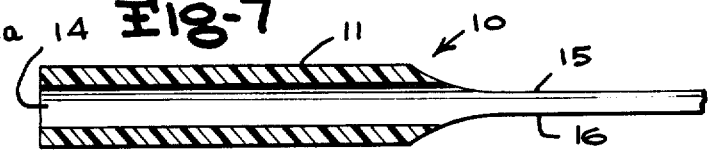

POSITIONING GUIDE FOR RUBBER-LIKE MATERIAL ROTARY CUTTING MACHINE

BACKGROUND AND OBJECTS OF THE INVENTION

The present invention relates in general to guide devices for positioning elongated small diameter generally cylindrical exterior shaped material fed between a pair of drive belts along a feed path, and more particularly to a positioning guide for belt feed rotary cutting machines for cutting rubber and plastic small diameter material of such shape to a cutting station for high speed cutting.

Heretofore, various devices have been proposed for feeding and cutting material such as rod-like continuous extruded bodies or similar tubular rubber or plastic stock wherein feed belts or similar feed members advance the material to a cutting station. Examples of these may be found in the prior Reinhart et al. U.S. Pat. Nos. 3,561,051 and 3,577,935 wherein continuous cylindrical extruded stock is fed to a cutter by a pair of feed belts. The Arnold et al. U.S. Pat. No. 3,423,497 discloses a similar type of feed arrangement for cylindrical continuous extruded stock, wherein the stock is advanced to a cutter by either a pair of grooved feed pulleys or a pair of similarly grooved endless feed belts. The Thorman et al. U.S. Pat. No. 3,530,536 also shows a pair of confronting feed belts and a cutter, the Hasten et al. U.S. Pat. No. 3,646,894 employs a similar pair of confronting endless feed belts, and the Borsvold U.S. Pat. No. 3,690,796 shows a pair of continuous feed belts embracing opposite sides of a cylindrical product. However, none of these patents disclose structure which satisfactorily constrains the material along the predetermined guide path in the most critical span between the exit zone from the confronting closely adjacent portions of the feed belts to the cutter where small continuous lengths of generally cylindrical exterior or rod shaped material of rubber or plastic material of similar properties are highly subject to getting out of position and producing an improper cut.

An object of the present invention is the provision of a novel positioning guide for extruded rubber or similar plastic small-diameter continuous lengths of generally cylindrical or rod-like stock material for effectively constraining the continuous feed material in the regions immediately adjacent the feed end and discharge end of the zone between a pair of elongated continuous drive belts and in the span between the exit end of the drive belt pair and a cutter to maintain precise positioning of the stock material at the cutter.

Another object of the present invention is the provision of a novel material positioning guide as described in the preceding paragraph, wherein the guide forms an elongated plate-like body having cylindrical guide bores at the inlet and outlet ends of the body and wherein the bore communicates along the feed axis with an intermediate slot of a width corresponding to the diameter of the guide bores which is exposed above and below to the adjacent parallel reaches of two feed belts to permit effective feeding of the stock material to a high speed rotary cutter while maintaining the material precisely positioned along the feed path.

Other objects, advantages and capabilities of the present invention will become apparent in the following detailed description, taken in conjunction with the accompanying drawings illustrating a preferred embodiment of the invention.

BRIEF DESCRIPTION OF THE FIGURES

FIG. 1 is a perspective view of the continuous rubber-like rod positioning guide of the present invention;

FIG. 2 is a perspective view of a typical high speed rotary rubber cutting machine of the type with which the positioning guide is to be used;

FIG. 5 is a transverse vertical view of the positioning guide taken along the line 5—5 of FIG. 1;

FIG. 6 is a horizontal longitudinal section view taken through the horizontal midplane of the positioning guide indicated 6—6 in FIG. 1; and FIG. 7 is a vertical longitudinal section view of the positioning guide, taken along the line 7—7 of FIG. 6.

DETAILED DESCRIPTION OF THE PREFERRED EMBODIMENT

Figure 4:
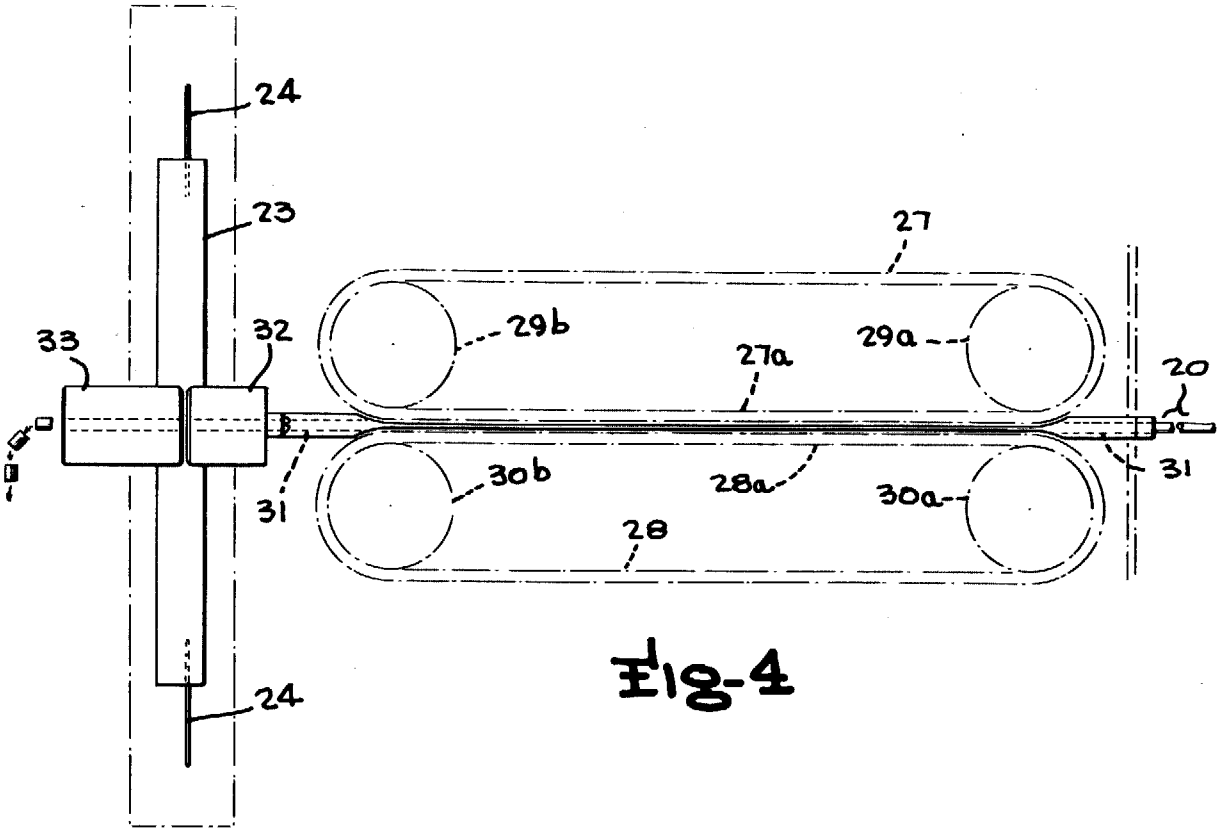
FIG. 4 is a somewhat diagrammatic side elevation view showing endless rubber feed belts of the cutting machine and the location of the positioning guide relative thereto shown adjacent the fly wheel and cutting knives and bushing assembly shown in FIG. 4.

Referring to the drawings, wherein like reference characters designate corresponding parts throughout the several figures, the positioning guide of the present invention is illustrated in FIG. 1 and designated generally by the reference character 10, and may be generally described as an elongated plate-like body 11 of greater transverse horizontal width than vertical thickness, having a feed or inlet end 12 and discharge or outlet end 13 forming vertical substantially rectangular end faces in the illustrated embodiment, and having a central guide bore indicated at 14 which extends entirely through the length of the plate 11 along the longitudinal center axis thereof. The plate-like body 11 may vary in vertical thickness as required by the diameter of the central guide bore 14 and the small diameter generally cylindrical continuous length of material to be fed therethrough, and includes upwardly and downwardly facing elongated, hollowed out flat-bottom trough-like depressions or relief cavities 15,16 with concave end transition surfaces near the ends 12, 13, which extend into and intersect the guide bore 14 along a major portion of the length thereof centered substantially on the longitudinal midpoint of the guide bore 14 providing a pair of upwardly and downwardly exposed slot formations 17, 18 over most of the length of the guide bore 14.

This positioning guide 10, as will be described more particularly hereafter, is designed to provide precisely guided support for materials such as small diameter extruded continuous stock material, for example rubber or plastic of similar deformable properties, as indicated generally at 20 in the drawings, which is to be fed between a pair of endless drive belts and advanced to the cutting station of a high speed rotary cutting machine or the like.

For example, the positioning guide of the present invention may be advantageously used with a high speed rotary rubber cutting machine such as the Versa-Cutter model 45 high speed cutter/puller machine produced by Foster and Allen, Inc., a subsidiary of Plastics Machinery Co., Inc. of Summerville, N.J., which is illustrated in FIG. 2 and indicated generally by the reference character 22. That machine is generally described as a rotary knife cutter wherein the knife cutting action is performed by a heavy motor drive fly wheel on which may be mounted one, two or four blades, with the fly wheel operating at variable speeds in the range from one hundred to one thousand rpm's permitting variation of cutting rates fron about one hundred cuts per minute to about four thousand cuts per minute. In the cutting machine of the illustrated example, the machine consists essentially of a large diameter cylindrical fly wheel, shown at 23 in FIGS. 3 and 4, having a plurality of cutter blades 24 fixed at circumferentiallly spaced positions about the perimeter of the fly wheel and mounted within a generally cylindrical safety guard 25 located adjacent a puller assembly indicated generally at 26 formed of a pair of endless belts 27, 28 positioned by associated endless belt drums 29*a,b* and 30*a,b* respectively. The belt drums and belts are positioned so that the adjacent flat reaches or horizontal adjacent confronting portions 27*a*, 28*a* span a substantial length of the material feed path, indicated generally at 31, over a distance, for example approximating about twelve or fourteen inches, just before delivery of the stock material 20 to the cutting station defined by the fly wheel 23 and blades 24. A pair of aligned stationary bushings 32, 33 spaced apart a distance just adequate to accommodate the thickness of the cutter blades 24 therebetween and having central cylindrical bores therethrough of a size to just accommodate passage of the stock material 20 are supported by frame members 34 flanking the cutting plane transversed by the blades 24. The controls for the cutting machine are housed in a single eye level console indicated at 35 in the typical rotary cutting machine herein illustrated, providing digital displays to indicate either cutter rpm or revolutions between knife extensions and a counter for recording the number of pieces cut from the stock material.

Figure 3:
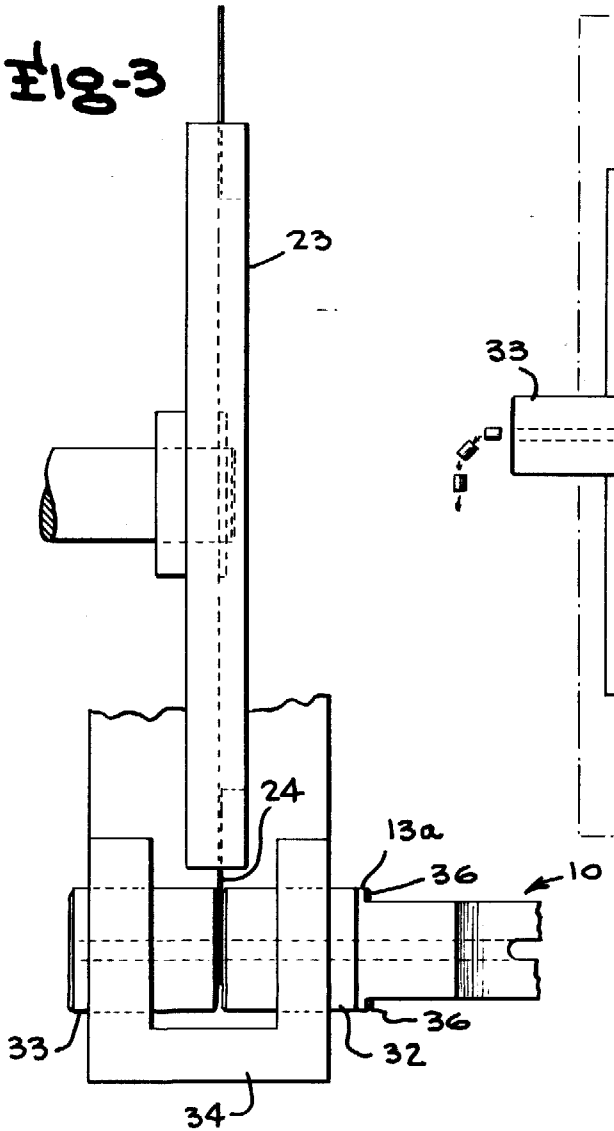
FIG. 3 is a fragmentary top plan view of the fly wheel and rotary cutting knife assembly and adjacent rubber-like stock material positioning bushing of the rotary cutting machine shown adjacent a portion of the positioning guide.

As illustrated in FIG. 3, the discharge end portion 13 of the plate-like body 11 has a pair of laterally extending apertures mounting ears or projections 13*a* through which mounting screws may extend, indicated for example at 36, to fix the discharge or outlet end 13 of the positioning guide to the stationary endlet bushing 32 of the cutting station, and the opposite or feed end 12 of the positioning guide body 11 is also provided with laterally extending apertured mounting ears 12*a* to receive mounting screws for fixing the feed end to adjacent stationary frame members of the cutting machine 22 (not shown).

It will be seen from the side elevation view of FIG. 4 that the thinned elongated intermediate portion 37 of the positioning guide 10 thus provides upwardly and downwardly facing flat bottom depressions or relief cavities 15, 16 whose upstream and downstream end transition surfaces, for example 15*a* and 15*b*, conform to the shape of the confronting surfaces of the drive belts 27, 28 which lie nearest the feed path of the stock material and are designed to engage and feed the stock material to the cutting station. Since the depressions or relief cavities 15, 16 intersect and, in effect, cut through the guide bore 14 along horizontal chords of the cross-sectional circle defined by the guide bore 14 leaving only the elongated slot indicated at 17, 18 through which the stock material 20 protrudes into engagement with the drive belts, the stock material is effectively constrained laterally along its proper guide path by the side edges of the intersected bore 14 and are constrained vertically by engagement with the drive belts 27, 28. The downstream end portion of the guide bore 14 adjacent the discharge end 13 and the zone between the two downstream drive belt rollers or drums 29*b*, 30*b* and the upstream bushing 32 thus defines a completely enclosed circular guide bore which provides precise guided material support in this most critical span along the stock material feed path.

While the positioning guide of the present invention has been described primarily in conjunction with feeding of cylindrical stock which is either solid material of circular cross-section or tubular material having a hollow center, it will be appreciated that other rubber-like continuous lengths of material can be cut at high speed and effectively guided so long as the predominant external surface shape of the material is substantially cylindrical, although it may be interrupted as in material of substantially "C" shaped cross-section and the like. The dimension of the guide, both as to its length, width and vertical height, and the diameter of the guide bore, will of course be selected to suit the dimensions of the particular extruded material to be cut. For example, this guide structure with suitably dimensioned guide bore may be used effectively to cut material of various sizes from about 3/32 inch outer diameter to 1½ inch diameter while maintaining the full advantages of the invention herein described.

While only one specific and detailed exemplary embodiment of the invention has been specifically illustrated and described, it is recognized that other changes or modifications may be made by those skilled in the art without departing from the spirit and scope of the invention as defined by the appended claims.

We claim:

1. A positioning guide for accurately positioning and guiding lengths of elongated rubber, plastic and other resiliant stock material having a predominantly cylindrical exterior surface configuration being fed along a predetermined straight feed path to a cutting machine having a rotary knife structure moving in a cutting plane transversely intersecting the feed path and having a pair of endless drive belts flanking the feed path providing closely adjacent confronting drive belt reaches extending between inlet and outlet nip formations along parallel planes to engage opposite surface portions of and drive the stock material along a belt drive zone spanning a length of the feed path; the positioning guide comprising an integral elongated plate-like body of a length greater than the span of said belt drive zone having feed and discharge ends and a straight guide bore extending therethrough of circular cross-section at said feed and discharge ends, said plate-like body having a width and thickness greater than the diameter of said guide bore at said ends and having a pair of opposite elongated flat-bottomed depressions each forming a relief cavity spanning the length of said belt drive zones in top and bottom faces respectively of the plate-like body, said cavities intersecting the path of the guide bore along planes paralleling the center axis of the bore for the length of said belt drive zone and receiving the confronting reaches of the drive belts therein, whereby the stock material extending through said guide bore is exposed in the region of said depressions along the span of said belt drive zone for driving and positioning contact with said confronting drive belt reaches while being constrained laterally by truncated portions of said guide bores remaining between said depressions.

2. A positioning guide as defined in claim 1, whereby said guide bore has feed end and discharge end portions of uninterrupted cylindrical shape extending upstream and downstream of the feed path from said inlet and outlet nip formations to accurately position the stock material along said feed path for predetermined distance spans extending from said nip formations.

3. A positioning guide as defined in claim 1, wherein said flat-bottomed depressions intersect said guide bore along parallel planes of intersection forming chords of the circle defined by the cross-section of the bore spaced to opposite sides of the center axis of the guide bore.

4. A positioning guide as defined in claim 2, wherein said flat-bottomed depressions intersect said guide bore along parallel planes of intersection forming chords of the circle defined by the cross-section of the bore spaced symmetrically to opposite sides of the center axis of the guide bore.

5. A positioning guide as defined in claim 1 wherein said elongated flat-bottomed depressions terminate at their upstream and downstream ends in concave end transition surfaces progressing outwardly from the planes of the flat bottoms of the cavities to the top and bottom faces of said plate-like body.

6. A positioning guide as defined in claim 2 wherein said elongated flat-bottomed depressions terminate at their upstream and downstream ends in concave end transition surfaces progressing outwardly from the planes of the flat bottoms of the cavities to the top and bottom faces of said plate-like body.

7. A positioning guide as defined in claim 3 wherein said said feed end and discharge end portions terminate in planar end faces lying in vertical planes perpendicular to the axis of the guide bore and feed path and said elongated flat-bottomed depressions terminate at their upstream and downstream ends in concave end transition surfaces progressing outwardly from the planes of the flat bottoms of the cavities to the top and bottom faces of said plate-like body.

8. A positioning guide as defined in claim 4 wherein said feed end and discharge end portions terminate in planar end faces lying in vertical planes perpendicular to the axis of the guide bore and feed path end said elongated flat-bottomed depressions terminate at their upstream and downstream ends in concave end transition surfaces progressing outwardly from the planes of the flat bottoms of the cavities to the top and bottom faces of said plate-like body.

9. A positioning guide as defined in claim 1 wherein said drive belts are trained about belt drums rotatable about horizontal axes and defining the inlet and outlet nip formations of the drive belt pair said elongated flat-bottomed depressions terminate at their upstream and downstream ends in concave end transition surfaces progressing outwardly from the planes of the flat bottoms of the cavities to parallel horizontal planes forming the top and bottom faces of said plate-like body with said concave end transition surfaces extending along cylindrical paths whose centers coincide with the center axis of the nearest belt drum and of only slightly greater diameter than that of the drive belt portion trained about said nearest belt drum to conform closely to the curvature thereof.

10. A positioning guide as defined in claim 2 wherein said drive belts are trained about belt drums rotatable about horizontal axes and defining the inlet and outlet nip formations of the drive belt said elongated flat-bottomed depressions terminate at their upstream and downstream ends in concave end transition surfaces progressing outwardly from the planes of the flat bottoms of the cavities to parallel horizontal planes forming the top and bottom faces of said plate-like body with said concave end transition surfaces extending along cylindrical paths whose centers coincide with the center axes of the nearest belt drum and of only slightly greater diameter than that of the drive belt portion trained about said nearest belt drum to conform closely to the curvature thereof.

11. A positioning guide as defined in claim 3 wherein said drive belts are trained about belt drums rotatable about horizontal axes and defining the inlet and outlet nip formations of the drive belt paid said feed end and discharge end portions terminate in planar end faces lying in vertical planes perpendicular to the axis of the guide bore and feed path and said elongated flat-bottomed depressions terminate at their upstream and downstream ends in concave end transition surfaces progressing outwardly from the planes of the flat bottoms of the cavities to parallel horizontal planes forming the top and bottom faces of said plate-like body with said concave end transition surfaces extending along cylindrical paths whose centers coincide with the center axes of the nearest belt drum and of only slightly greater diameter than that of the drive belt portion trained about said nearest belt drum to conform closely to the curvature thereof.

12. A positioning guide as defined in claim 4 wherein said drive belts are trained about belt drums rotatable about horizontal axes and defining the inlet and outlet nip formations of the drive belt pair said beed end and discharge end portions terminate in planar end faces lying in vertical planes perpendicular to the axis of the guide bore and feed path and said elongated flat-bottomed depressions terminate at their upstream and downstream ends in concave end transition surface progressing outwardly from the planes of the flat bottoms of the cavities to parallel horizontal planes forming the top and bottom faces of said plate-like body with said concave end transition surfaces extending along cylindrical paths whose centers coincide with the center axis of the nearest belt drum and of only slightly greater diameter than that of the drive belt portion trained about said nearest belt drum to conform closely to the curvature thereof.

* * * * *